United States Patent [19]

Dubinsky

[11] 4,057,291

[45] Nov. 8, 1977

[54] REMOVABLE COVER FOR OUTDOOR-TYPE CHAIRS

[76] Inventor: Emanuel Dubinsky, 99 Kingston Ave., Yonkers, N.Y. 10701

[21] Appl. No.: 705,611

[22] Filed: July 15, 1976

Related U.S. Application Data

[63] Continuation-in-part of Ser. No. 538,455, Jan. 3, 1975, Pat. No. 4,010,980.

[51] Int. Cl.[2] ..... A47C 4/30

[52] U.S. Cl. ..... 297/441; 160/371

[58] Field of Search ..... 297/441; 160/371; 24/16 PB; 5/191, 187

[56] References Cited

U.S. PATENT DOCUMENTS

| | | | |
|---|---|---|---|
| 852,776 | 5/1907 | Druding | 5/191 X |
| 1,814,579 | 7/1931 | Ames | 5/187 X |
| 2,934,134 | 4/1960 | Adler | 160/371 |
| 3,367,392 | 2/1968 | Green | 160/371 |
| 3,375,861 | 4/1968 | Marlow | 160/371 |
| 3,601,863 | 8/1971 | Dorsey | 24/16 PB |
| 3,605,199 | 9/1971 | Eberhardt | 24/16 PB |

FOREIGN PATENT DOCUMENTS

| | | | |
|---|---|---|---|
| 102,224 | 7/1965 | Denmark | 24/16 PB |

*Primary Examiner*—Francis K. Zugel
*Attorney, Agent, or Firm*—Hubbell, Cohen, Stiefel & Gross

[57] ABSTRACT

An improved removable cover for an outdoor-type chair useable as a replacement for the existing covers thereon, to restore such existing covers or to reinforce an originally installed cover therefor, such as an originally installed cover comprising a plurality of horizontal tubular straps. The improved cover comprises at least a plurality of vertical straps having separable interlockable first and second corresponding ends, with one of the corresponding ends comprising an adjustable buckle closure device having a cross-bar member positionable adjacent one of a plurality of through-hole apertures in said end and the other of said ends having a through-hole aperture therein, such as through a reinforced loop portion, with a longitudinally serrated ratchet-type strip having a plurality of longitudinally extending serrations therein and a buckle-type closure at one end thereof having an aperture therein with a pawl-like means extending into the aperture being insertable through said one aperture in said one end and said aperture in said open end of said strap and engageable in ratchet fashion with the serrations when the serrated strip end is inserted through the aperture to interlock said strap ends together about the chair frame. This forms an adjustable self-tightening tension means due to the ratchet type interaction between the pawl and serrations. A similar adjustable tension means may also be provided for a plurality of horizontal straps through which the vertical straps are extendable in a woven-like configuration. These vertical straps and/or horizontal straps may be separable or form an interconnected harness. Moreover, the corresponding ends of the straps themselves may comprise the longitudinally serrated ratchet type strip and buckle-type closure, respectively.

5 Claims, 12 Drawing Figures

FIG. 6.
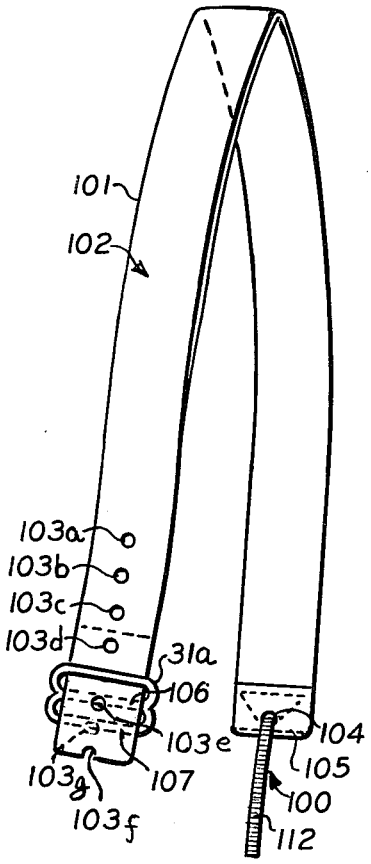
FIG. 7.
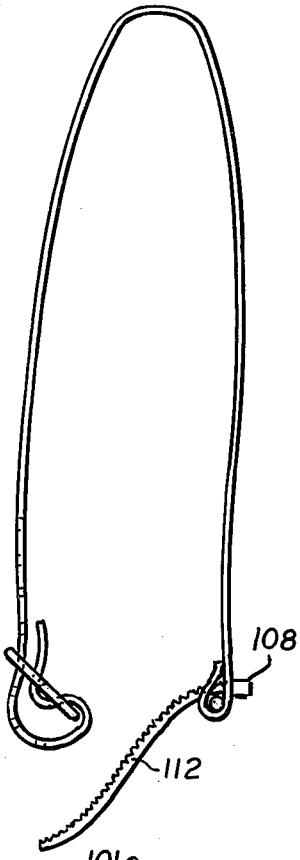
FIG. 8.
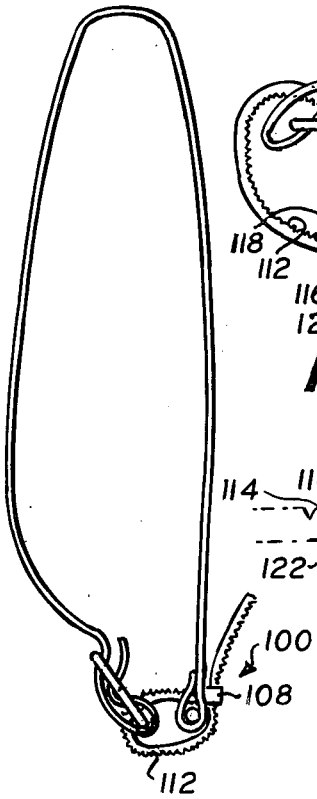
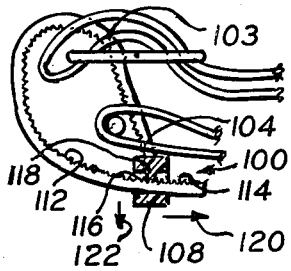
FIG. 9
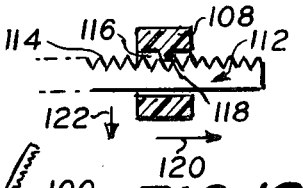
FIG. 12
FIG. 10.
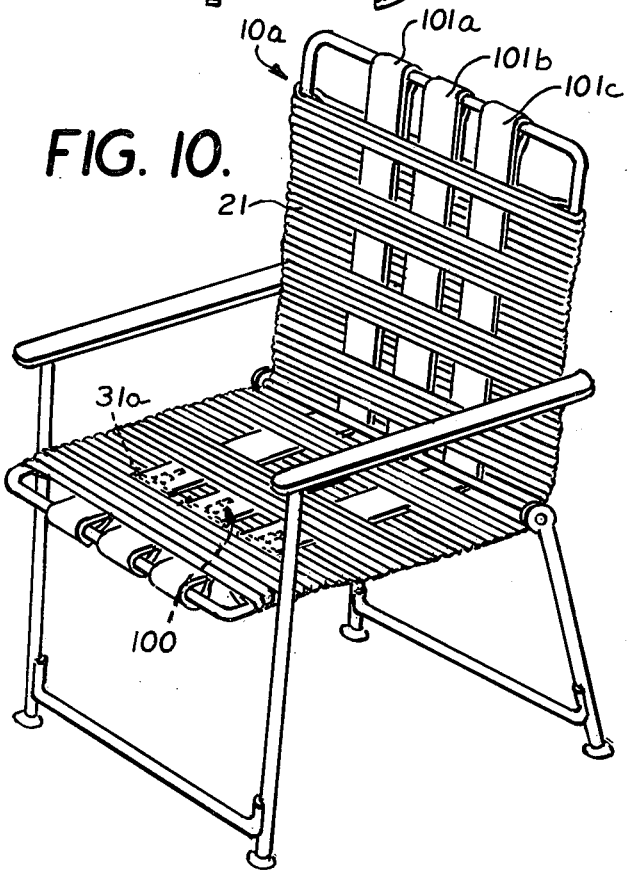
FIG. 11.
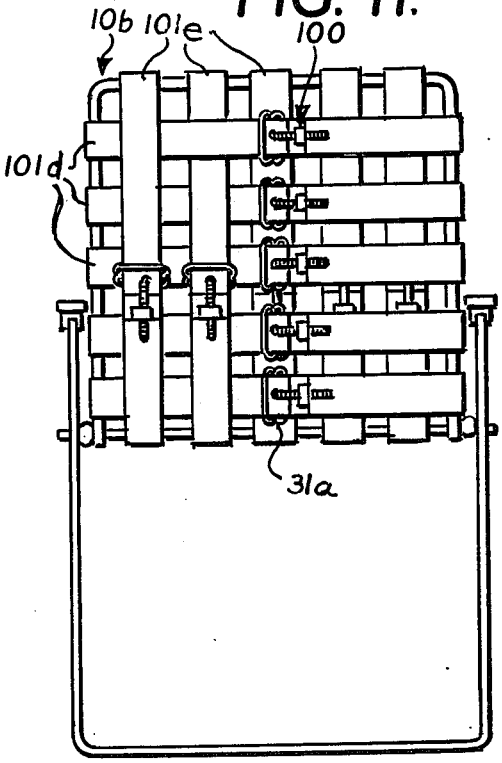

REMOVABLE COVER FOR OUTDOOR-TYPE CHAIRS

CROSS-REFERENCE TO RELATED APPLICATIONS

This application is a continuation-in-part of my copending U.S. patent application entitled "Covers for Outdoor Chairs", bearing Ser. No. 538,455, filed Jan. 3, 1975, now U.S. Pat. No. 4,010,980, the contents of which are specifically incorporated by reference herein, and is an improvement thereon.

BACKGROUND OF THE INVENTION

1. Field of the Invention

The present invention relates to removable covers for outdoor-type chairs.

2. Description of the Prior Art

Removable covers for furniture, particularly of the type generally termed outdoor furniture, such as for lawn or garden, although such furniture may of course be used indoors, are well known in the prior art. Examples of such prior art removable covers are disclosed in U.S. Pat. Nos. 3,667,532; 2,665,745; 1,391,362; 2,934,134 and 3,512,834. However, none of these prior art removable covers presently known to the Inventor other than my copending U.S. patent application Ser. No. 538,455, filed Jan. 3, 1975, now U.S. Pat. No. 4,010,980, over which the invention recited herein is an improvement, employs a satisfactory adjustable self-tightening tension means for securing an adjustable size cover comprising a plurality of interwoven vertical and horizontal straps to a chair frame to secure the cover to the frame, at a desired adjustable tension level, in position for covering the back and seat of the chair. These disadvantages of the prior art are overcome by the present invention.

SUMMARY OF THE INVENTION

A removable cover for a chair having a frame having a seat portion and a back portion is provided. The cover comprises at least a first plurality of vertical straps extendable about the frame over the top of the frame back portion and the bottom of the frame seat portion, with each of the vertical straps being extendable over some of a plurality of spaced apart horizontal straps disposed about the frame and under some other of the disposed horizontal straps in a woven-like configuration. The plurality of vertical straps may be separable or form an interconnected harness. Each of the vertical straps has separable and interlockable first and second corresponding ends with interlocking means associated with said ends for interlocking said ends about the frame at a desired tension level which is adjustable, and holding the tension at this level. The interlocking means comprises a tension adjusting tool which comprises a longitudinally serrated ratchet-type strip having a plurality of longitudinally extending serrations therein and a buckle-type closure at one end thereof having an aperture therein and a pawl-like means extending into the aperture and engageable therein in ratchet fashion with the serrations. The first end is insertable into the corresponding second end buckle-type closure, such as through apertures in the corresponding ends of the strap and through the closure aperture and interlockable therein by such ratchet fashion engagement of the pawl-like means with the serrations for adjusting the tension of the interlocked vertical strap and holding the tension at a desired level. The pawl-like means is sequentially engageable with the longitudinal serrations during the adjustment of the vertical strap tension. The cover may also comprise the plurality of horizontal straps which are each preferably extendable about the frame and have separable and interlockable first and second corresponding ends interlockable in a manner similar to that described above for the vertical straps to form an adjustable selftightening tension means comprising the tension tool having the serrated end and the buckle-type closure end having a pawl-like means to adjust the tension of the interlocked horizontal strap and hold the tension at a desired level due to the ratchet fashion engagement of the pawl-like means with the serrations.

BRIEF DESCRIPTION OF DRAWINGS

FIG. 6 is a front view similar to FIG. 1, of an embodiment of a typical strap of the improved removable chair cover of the present invention;

FIG. 7 is a side view, similar to FIG. 2, of the typical strap of the improved removable chair cover of FIG. 6;

FIG. 8 is a side view, similar to FIG. 7, of the typical strap of the improved removable chair cover of FIG. 6 illustrating the interlocking of the corresponding ends of a vertical strap;

FIG. 9 is an exploded fragmentary sectional view of the interlocked presently preferred adjustable self-tightening tension means of FIG. 8;

FIG. 10 is a perspective view of a chair, similar to FIG. 3, provided with the presently preferred embodiment of the improved removable cover employing only separable vertical straps;

FIG. 11 is a rear view, similar to FIG. 5, of a chair provided with the presently preferred embodiment of the improved removable cover employing both separable vertical and horizontal straps; and FIG. 12 is a further exploded fragmentary sectional view of the interlock portion of the preferred adjustable self-tightening tension means shown in FIG. 9.

DETAILED DESCRIPTION OF THE PREFERRED EMBODIMENTS

For purposes of clarity and completeness, before describing the presently preferred improved removable chair cover of the present invention shown in FIGS. 6 through 12, my previous copending U.S. patent application Ser. No. 538,455, filed Jan. 3, 1975, now U.S. Pat. No. 4,010,980, shall be described with reference to FIGS. 1 through 5.

Figure 1:
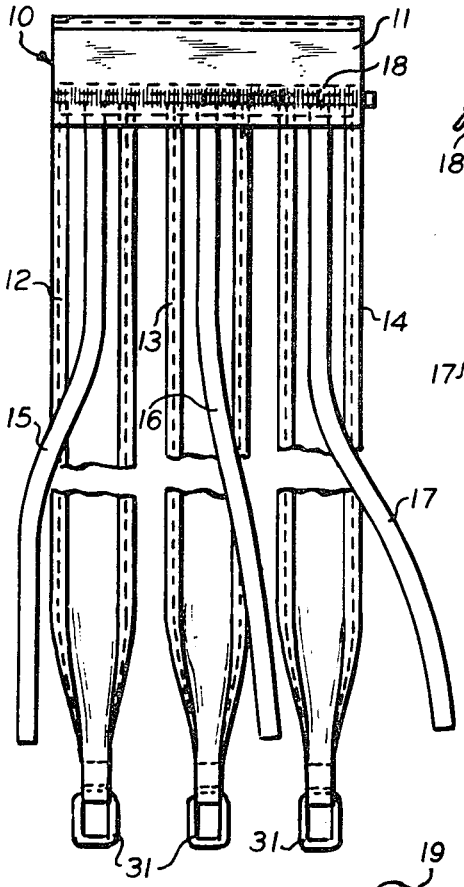
FIG. 1 is a rear view of an embodiment of a removable chair cover in accordance with my previous invention described in U.S. Ser. No. 538,455, filed Jan. 3, 1975, now U.S. Pat. No. 4,010,980.
Figure 2:
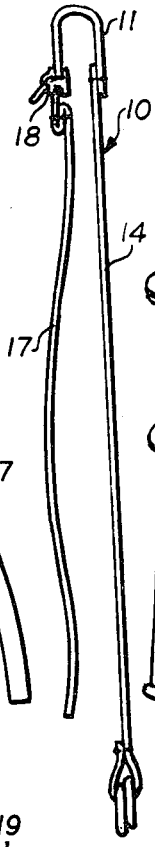
FIG. 2 is a side view of the removable chair cover of FIG. 1.
Figure 3:
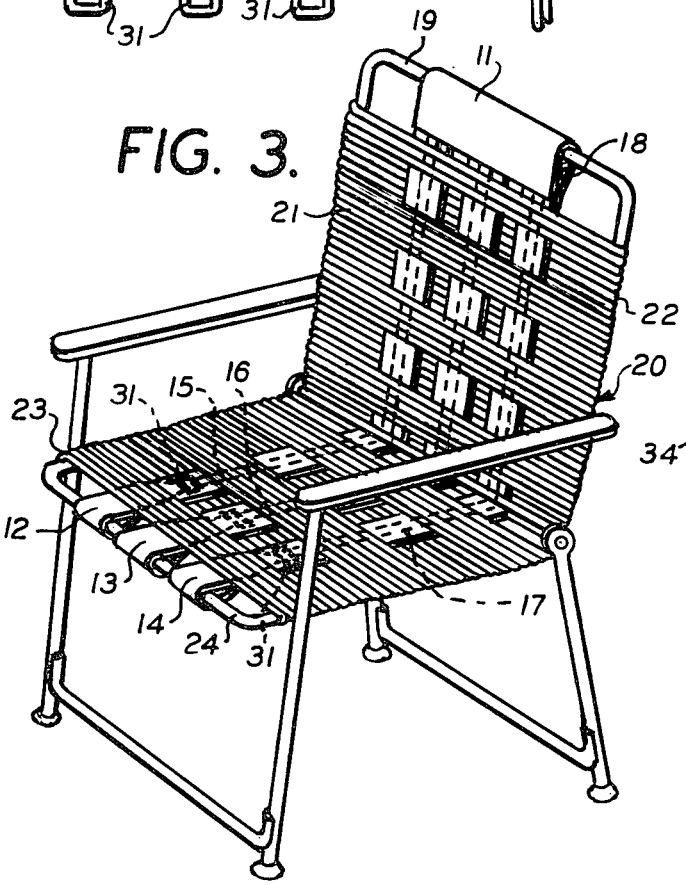
FIG. 3 is a perspective view of a chair provided with the removable chair cover of FIG. 1.

The chair cover 10 shown in FIGS. 1 to 3 consists of a top piece 11, wider straps 12, 13 and 14, and narrower straps 15, 16 and 17. The cover can be made of any suitable fabric, preferably cotton duck or vinyl laminated nylon. The top piece 11 has the shape of an elongated tube and its opposed ends are joined by a zipper 18. As shown in FIG. 3, the top piece 11 is placed over the top frame portion 19 of a chain 20 and is then fixed by actuating the zipper 18. The chair 20 has a plurality of horizontal tubular vinyl straps 21 of the usual type extending horizontally across the back 22 of the chair and across the seat 23. The straps 21 extend around the frame 24 of the chair and are fixed to the frame by means well known in the art. They extend parallel to each other with narrow spaces being provided between two adjacent straps. In the illustrated embodiment, three wide straps 12, 13 and 14, have ends sewn to an edge of the piece 11. Three narrow straps 15, 16 and 17 are also sewn by their ends to the under part of the piece 11. Each narrow strap is located substantially in the middle of a wider strap. Obviously, the number of the straps may vary, depending upon the width of the chair. After the top piece 11 has been attached, the wide straps are connected to the chair by a weaving motion, namely, the user first takes the wide strap 12, moves it under a few tubular straps 21, then pulls the strap 12 outwardly through the space between two adjacent straps 21, then extends the strap 12 over a few straps 21, then pulls the strap 12 inwardly, extends it behind a few adjacent straps 21, then pulls the strap 12 outwardly again and continues this operation until the strap 12 reaches the last outer straps 21 of the seat. Then the user carries out the same procedure with the strap 13, and then with the strap 14. Obviously, these straps can extend over the same tubular straps 21 or over different straps, thereby creating different designs in the chair. The ends of the wide straps 12, 13 and 14 are held in place by being attached to the ends of narrow straps 15, 16 and 17, respectively. This is accomplished by extending the narrow straps behind the back and the seat of the chair and then connecting them with the wider straps by buckle devices 31 carried by the ends of the wide straps. These buckle devices are of the usual type; they are self-tightening, so that they can provide a tight connection of the cover upon the chair. Obviously, grommets or pressure rings can be used for the same purpose. It is apparent that the holding straps 15, 16 and 17 are essentially concealed from view.

Figure 4:
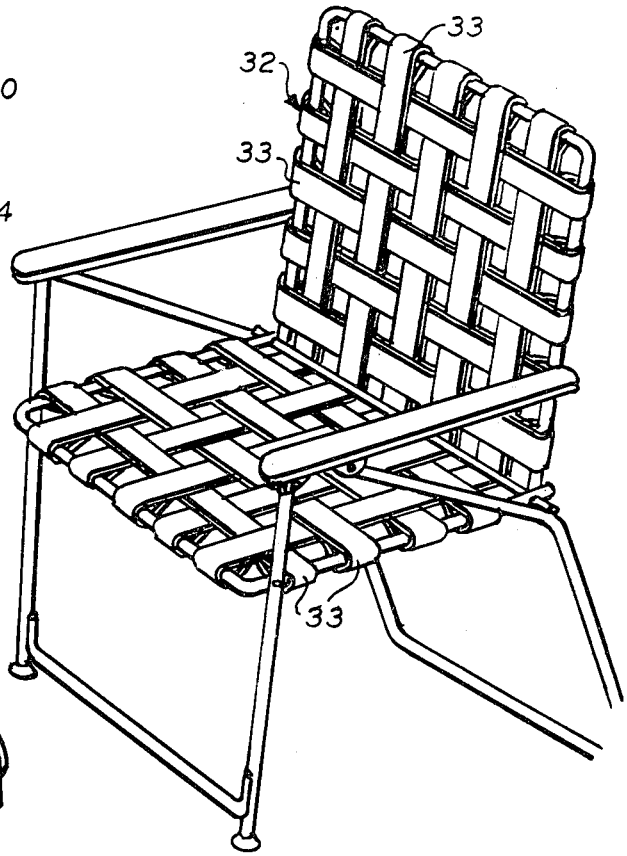
FIG. 4 is a perspective view of a chair provided with an alternative embodiment of a removable chair cover in accordance with my previous invention described in U.S. Ser. No. 538,455, filed Jan. 3, 1975, now U.S. Pat. No. 4,010,980.
Figure 5:
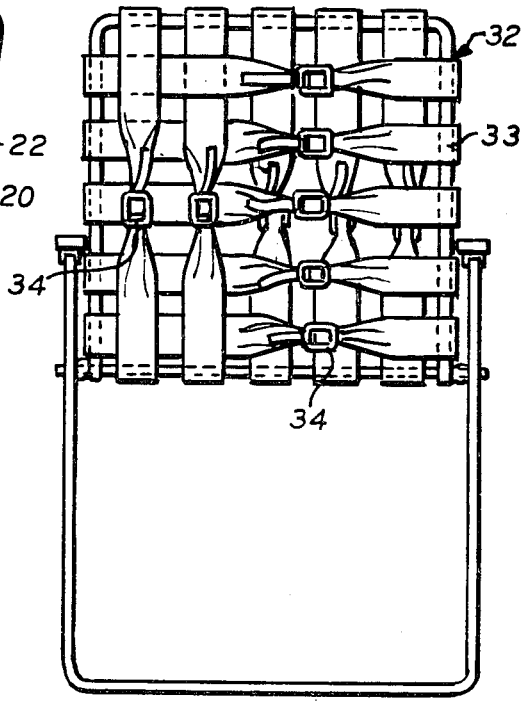
FIG. 5 is a rear view of the chair of FIG. 4.

FIGS. 4 and 5 show a different embodiment, namely a chair 32 which consists entirely of wide straps 33. These straps extend partly over each other to provide a weaving appearance. Each strap has its ends connected behind the chair by a buckle device 34. Since no tubular straps are provided, the use of a top piece is eliminated. A zipper-carrying horizontal strap 35 extends under the strap 33 and is connected behind all vertical straps. The advantage of this strap 35 is that it distributes the point of stress to two separate locations, one location being the zipper and the other location being that of the buckle on the vertical strap. Another advantage of the zipper-strap 35 is that is secures the vertical straps in place and prevents their shifting. The general advantage of the complete wrap around straps is that there is no longer a wearing out at a location where screws or metal clips were used heretofore.

Referring now to FIGS. 6 through 12, the presently preferred improved adjustable self-tightening tension means of the present invention, generally referred to by the reference numeral 100 for a typical preferred strap 101 of the presently preferred improved removable chair cover of the present invention, shall now be described. As shown and preferred in FIGS. 10 and 11, the straps 101 are preferably separable and may comprise separable vertical straps only (FIG. 10) or both separable vertical and horizontal straps (FIG. 11), the straps 101 preferably being employed in a woven-like configuration in either instance in which the straps 101 are preferably both individually insertable and removable. FIG. 10 consists of solely insertable vertical straps 101*a,* 101*b* and 101*c* being shown by way of example, which are interwoven through the plurality of horizontal tubular vinyl straps 21 originally installed on the chair to reinforce the same, while FIG. 11 consists of a woven-like configuration of both horizontal 101*d* and vertical 101*e* straps which form the improved removable cover for the back and seat portions of the chair. The primary difference between the covers 10*a* and 10*b* of FIGS. 6 through 12 and the previously described covers of FIGS. 1 through 5 is in the aforementioned self-tightening tension means 100 which is preferably common to covers 10*a* and 10*b,* being preferably identical for both the horizontal and vertical straps 101*d* and 101*e,* respectively, of cover 10*b,* and for the vertical straps 101*a,* 101*b* and 101*c* of cover 10*a.* Accordingly, only a typical improved adjustable self-tightening tension means or tension adjusting tool 100 for a typical preferred strap 101, by way of example, shall be described with reference to FIGS. 6 through 12.

As shown and preferred in FIGS. 6–9 and 12, the typical preferred strap 101 preferably comprises a vinyl-like flat strap 102 having a plurality of through-hole apertures therein at one of the corresponding ends, seven such apertures 103*a,* 103*b,* 103*c,* 103*d,* 103*e,* 103*f,* and 103*g* being shown by way of example in FIGS. 6 through 8, with each of said apertures 103*a*–103*g* preferably being spaced a predetermined longitudinal distance, such as 3/4 inches apart, to enable the strap 101 to adjustably fit about the frame of any conventional size outdoor-type chair when tensioned, as will be explained in greater detail hereinafter. In addition, strap 101 preferably has another through-hole aperture 104 located at the other corresponding end thereof which is cooperable with tension means 100 and a selected one of apertures 103 at the other end to form the adjustable tension interlock of the corresponding ends of the strap 101 about the chair frame. Preferably, the end of strap 101 at which through-hole aperture 104 is located comprises a reinforced portion having reinforcement means, such as a metal bar 105 therein, adjacent aperture 104 for providing tension bearing support for tension means 100, as will be described in greater detail hereinafter. The end of strap 101 at which through-hole apertures 103 are located preferably includes a conventional slide buckle-type device 31*a* having a cross-bar piece 106 through which this end of the strap 101 is adjustably threaded to conventionally vary the longitudinal length of strap 101 with the aperture 103 associated with that length when the strap 101 is properly tensioned about the chair frame being preferably positioned directly above bottom cross-bar 107 of buckle 31*a* for providing tension bearing support for tension means 100. Thus, slide buckle 31*a* enables both adjustability in strap size and tension bearing support, as will be described in greater detail hereinafter.

Tension means 100 preferably comprises a tension adjusting tool which also serves as the locking mechanism itself for the preferred interlock formed by the apertures 103 and 104 in the strap ends and tension means 100. Preferably, tension means 100 comprises a buckle-type closure 108 at one end thereof (FIGS. 7–9, 12) having a longitudinally serrated ratchet-type strip 112 extending therefrom. Strip 112 preferably has a plurality of longitudinally extending teeth or serrations 114 (FIGS. 9,12) therein as shown in greater detail in the exploded views of FIGS. 9 and 12. The buckle-type closure 108 preferably has an aperture 116 therein. A pawl-like tooth 118 preferably extends into the aperture 116 and is preferably engageable therein in conventional ratchet-like fashion with the serrations 114 of strip 112 as shown in FIGS. 9 and 12. As shown in FIGS. 8, 9 and 12, the strip 112 extending from buckle-type closure 108 is preferably insertable through aperture 104 and apertures 103*g* and 103*e*, by way of example, and into buckle-type closure 108 through aperture 116 and interlockable therein due to the aforementioned ratchet-like engagement of the pawl 118 with the serrations 114. Preferably, since this aforementioned engagement is preferably ratchet-like, the tension of the strap 101 can readily be adjusted by pulling strip 112 in the direction of arrow 120 (FIGS. 9, 12) with the pawl 118 permitting such advance, whereas the engagement of pawl 118 with the serrations 114 prevents withdrawal of strip 112 in the opposite direction thereby holding the tension at the desired level. Thus, the pawl 118 is preferably sequentially engageable with the serrations 114 during adjustment of the strap 101 tension. To disengage the pawl 118 and serrations 114, one need only pull down on strip 112 in the general direction of arrow 122 (FIGS. 9,12); however, such downward movement will not normally occur when stress is otherwise normally applied during use to the interlocked strap 101.

With respect to FIG. 10, each of the vertical straps 101*a*, 101*b* and 101*c* of cover 10*a* are preferably individually interwoven through the back and seat portions of the chair over the top and bottom of the frame and preferably connected in the back thereof in the same manner as the aforementioned interconnection of strap 101 with the tension thereof each individually adjusted and held at a desired level by use of tension means 100. However, before interlocking the corresponding ends of each of the vertical straps 101*a*, 101*b* and 101*c*, each are adjusted to the correct length or size for fitting about the chair frame by use of slide buckle 31*a* with the buckle 31a preferably being adjusted about the frame until a predetermined spacing, such as preferably approximately one inch, exists between the corresponding ends of the strap 101, with care being taken to preferably insure that a selected aperture 103 through which tension means 100 is to be inserted is positioned above cross-bar 107 of buckle 31*a*. Thereafter, strip 112 is preferably inserted through aperture 104 until closure 108 bears against the outside of flat surface 102 of strap 101 (FIGS. 8, 9) and then through the selected apertures 103*g* and 103*e*, by way of example, in the other corresponding end of the strap 101 and thereafter through aperture 116 in closure 108 and tightened in ratchet-like fashion to bring the corresponding ends of the strap 101 together about the chair frame at the desired tension level. At this point, the strip 112 preferably bears in tension against reinforcing support members 107 and 105 to prevent wearing away of the apertures in response to stress. If desired, after this has occurred, the extraneous portion of strip 112 extending through aperture 116 may be severed. This procedure is repeated for each of the straps 101*a*, 101*b* and 101*c*. Similarly, with respect to FIG. 11, the horizontal and vertical straps 101*d* and 101*e*, respectively, are each preferably adjusted in size and individually interwoven in conventional fashion about the chair frame, with the vertical straps 101*d* going over the top and bottom of the frame and the horizontal straps 101*e* going around the sides of the frame in any desired order, although preferably first putting on all the horizontal 101*d* or all of the vertical straps 101*e* and then threading the straps of the other direction, vertical 101*e* or horizontal 101*d*, respectively, therethrough to form the desired woven-like configuration, with each of the straps 101*d* and 101*e* preferably being connected in the back of the frame in the same manner as the aforementioned interconnection of straps 101, 101*a*, 101*b* and 101*c*, with the tension thereof each individually adjusted and held at a desired level by use of the tension means 100.

By use of the removable cover of the present invention, the cover may be applied thereto quickly and simply by persons of limited skills, with the adjustable tension means enabling the cover to be readily applied to chair frames of different sizes. Furthermore, the cover can be readily removed for ease in cleaning and replacement, may be of any desired configuration, and can be used for new chairs as well as to reinforce worn chairs or replace the covers thereof.

It is to be understood that the above described embodiment of the invention is merely illustrative of the principles thereof and that numerous modifications and embodiments of the invention may be derived within the spirit and scope thereof, such as by having one corresponding end of the strap itself comprise the longitudinally serrated ratchet-type strip and the other corresponding end of the strap comprise the buckle-type closure having the pawl-like means to provide the ratchet-type interlock or by employing one of the described embodiments for horizontal straps and a different embodiment for vertical straps, or vice versa.

What is claimed is:

1. A removable cover for a chair having a frame having a seat portion and a back portion, said cover comprising a first plurality of straps extendable about said frame, each of said straps having separable and lockably interconnectable first and second corresponding ends having through apertures therein and a tension adjusting means insertable through and cooperable with said first and second corresponding end apertures for lockably interconnecting said strap about said frame at a desired tension level, said first corresponding end of each of said first plurality of straps comprising a plurality of said through apertures longitudinally spaced apart along the length of said strap by a predetermined distance therebetween and an adjustable slide buckle means having a plurality of spaced apart cross bar members through which said first corresponding end of said strap is adjustably and lockably threadable for varying the longitudinal length of said strap, said second corresponding end of each of said first plurality of straps comprising at least one through aperture and a reinforcement bar means adjacent said one aperture capable of substantially evenly distributing tension applied thereto for providing tension bearing support for said one aperture, one of said plurality of apertures in said first corresponding end being positionable adjacent said cross bar member closest to the adjusted end length of said strap for each variable length of said strap, said closest cross bar member adjacent said positionable one aperture being further capable of substantially evenly distributing tension applied thereto for providing tension bearing support for said positionable one aperture for enabling said slide buckle means to provide both strap size adjustability and tension bearing support for said positionable one aperture, said tension adjusting means comprising a buckle-type closure larger in size than said strap apertures and having an aperture therein with a pawl-like means extending into said closure aperture and a longitudinally serrated ratchet-type strip having a plurality of longitudinally extending serrations therein and extendable into said buckle-type closure aperture with said serrations being engageable with said pawl-like means in ratchet fashion, said ratchet-type strip being insertable through said strap first corresponding end positionable one aperture and said second corresponding end one aperture and said buckle-type closure aperture and interlockable therein by said ratchet fashion engagement of said pawl-like means with said serrations for adjusting the tension of said lockably interconnected straps and holding said tension at a desired level, said pawl-like means being sequentially engageable with said longitudinal serrations during said adjustment of said strap tension, said interlockable ratchet-type strap bearing on tension against said reinforcement bar and said slide buckle means closest cross bar member both during adjustment of said tension and during holding of said tension at said desired level, whereby the tension applied to said first corresponding end positionable one aperture and said second corresponding end one aperture is substantially evenly distributed between said strap first and second corresponding ends, said first plurality of straps being extendable substantially parallel to each other with spaces between adjacent straps when said straps are extended about said frame, and a second plurality of straps extendable about said frame over some of said first plurality of straps and under some other of said first plurality of straps in a woven-like configuration, said first and second plurality of straps being cooperable in said woven-like configuration in a position for covering said back and seat of said chair.

2. A removable cover in accordance with claim 1 wherein said first plurality of straps comprises horizontal straps and said second plurality of straps comprises vertical straps extendable over the top of said frame back portion and the bottom of said frame seat portion, each of said vertical straps having separable and lockably interconnectable ends lockably interconnecting said corresponding strap ends behind said frame to secure said cover to said frame in said position for covering said back and seat of said chair.

3. A removable cover in accordance with claim 1 wherein said longitudinally serrated ratchet type strip extends from said buckle-type closure at one end thereof and is extendable into said buckle-type closure aperture at the other end thereof, said tension adjusting means comprising both a tension adjusting tool and an interlocking means.

4. A removable cover in accordance with claim 1 wherein said first corresponding end of said strap is adjustably threadable through slide buckle means for adjusting the longitudinal extent of said strap about said chair frame for providing a predetermined untensioned spacing between said first and second corresponding ends prior to said insertion of said ratchet-type strip through said first corresponding end positionable one aperture and said subsequent lockable interconnection of said strap about said frame at said desired tension level.

5. A removable cover in accordance with claim 2 wherein each of said vertical straps lockably interconnectable first and second corresponding ends have through apertures therein and a tension adjusting means insertable through and cooperable with said first and second corresponding end apertures lockably interconnecting said vertical strap about said frame at a desired tension level, said tension adjusting means comprising a buckle-type closure larger in size than said strap apertures and having an aperture therein with a pawl-like means extending into said closure aperture and a longitudinally extending serrated ratchet-type strip having a plurality of longitudinally extending serrations therein and extendable into said buckle-type closure aperture with said serrations being engageable with said pawl-like means in ratchet fashion, said ratchet type strip being insertable through said vertical strap first and second corresponding end apertures and said buckle-type closure aperture and interlockable therein by said ratchet fashion engagement of said pawl-like means with said serrations for adjusting the tension of said interlocked vertical straps and holding said tension at a desired level, said pawl-like means being sequentially engageable with said longitudinal serrations during said adjustment of said vertical strap tension.

* * * * *